United States Patent [19]

Horning

[11] Patent Number: 4,644,365

[45] Date of Patent: Feb. 17, 1987

[54] ADJUSTABLE ANTENNA MOUNT FOR PARABOLIC ANTENNAS

[76] Inventor: Leonard A. Horning, 1799 N. River Dr., Kamloops, B.C., Canada, V2B 7N4

[21] Appl. No.: 699,577

[22] Filed: Feb. 8, 1985

[51] Int. Cl.[4] ..... H01Q 3/08

[52] U.S. Cl. ..... 343/882; 343/757; 248/183

[58] Field of Search ..... 343/878–882, 343/840, 890, 757, 765, 766, 359; 248/183, 185, 122

[56] References Cited

U.S. PATENT DOCUMENTS 4,232,320 11/1980 Savalle ..... 343/882
4,454,515 6/1984 Major et al. ..... 343/882
4,475,110 10/1984 Hutchins ..... 343/766
4,528,569 7/1985 Felter et al. ..... 343/882

FOREIGN PATENT DOCUMENTS 2120856 12/1983 United Kingdom ..... 343/757

*Primary Examiner*—Eli Lieberman
*Assistant Examiner*—Michael C. Wimer

[57] ABSTRACT

An antenna mount for aiming a parabolic antenna towards a geosynchronous satellite characterized by four, pivotal sub-assemblies, each of which is rotatable around its own axis. The mount can be quickly adjusted to point the antenna at a particular geosynchronous satellite, or may be caused to sweep across the satellite belt in a scanning manner. The antenna mount can be attached to a support post of virtually any orientation ranging from vertical to horizontal.

16 Claims, 7 Drawing Figures

14
24
26
26
64
34
56
22
6
88
36
6
20
26
90
30
78
55
38
28
18
10
22
16
12
16

A1
A2
A3
A4
3
4
7
64
68
34
66
60
56
58
32
48
46
52
53
30
54
51
55
57
40
38
72
70
62
28
18
22
88
76
74
78
80
82
36
84

ADJUSTABLE ANTENNA MOUNT FOR PARABOLIC ANTENNAS

BACKGROUND OF THE INVENTION

1. Field of the Invention

This invention relates generally to antenna mounts, and more particularly to mounts for aiming a parabolic antenna towards communication satellites in geosynchronous orbit.

2. Description of the Prior Art

There are a great number of communication satellites parked in geosynchronous orbit 22,300 miles above the equator of the earth. Highly directional parabolic antennas are used to receive the signals transmitted from these geosynchronous satellites.

To receive an adequate signal, the parabolic antenna must be accurately aimed at a geosynchronous satellite. To accomplish this task, a number of designs for adjustable antenna mounts have been devised.

Since all of the geosynchronous satellites lie along a plane through the earth's equator, any parabolic antenna in the Northern hemisphere should be pointed south. The angle of elevation of the antenna depends upon the latitude at which it is being used, where the angle of elevation decreases with increasing latitude. The antenna should also be able to sweep along the satellite belt so that it may be aimed at the desired geosynchronous satellite.

A great many antenna mounts have been devised which are used to aim a parabolic antenna towards a geosynchronous satellite. Most fall into two main categories. A first category of antenna mount utilizes a number of legs to support the antenna, where two or more of the legs are adjustable to provide the proper elevation of the antenna and to align the axis rotation of the antenna with a vertical plane.

A problem with this type of antenna mount is that it is very difficult to set the mounts accurately, and any error in setting the mount will make proper tracking with the antenna impossible. The difficulty of setting up the first type of mount is compounded by the fact that adjustment of one of the legs will often cause the other adjustable leg(s) to become unadjusted.

The other major type of antenna mount utilizes a single support pole having a head which permits rotation for North/South orientation, and for the proper elevation. If, however, the post is not set exactly vertical, tracking becomes once again impossible.

Examples of tripodal mounts for parabolic dishes can be found in U.S. Pat. No. 3,945,015 of Guegeun, and U.S. Pat. No. 4,086,599 of VanderLinden, Jr. et al. The Gueouen patent describes a support structure for an antenna mounted at three points on a steering mounting resting on the ground. One of the points is situated at the apex of the support frame and is provided with a bi-directional joint which allows the antenna to pivot around an azimuthal and elevational axes. The bi-directional joint is mounted to pivot on the base mounting around an axis which is perpendicular to the azimuthal and elevational axes. The VanderLinden, Jr. et al. patent describes a composite antenna which is secured to a foundation by a multi-element truss-like pedestal. The pedestal provides elevation and azimuth rotational axes for selecting and adjusting the reflector point orientation.

SUMMARY OF THE INVENTION

An object of this invention is to provide a simple, easy to use antenna mount for directional antennas.

Another object of this invention is to provide an antenna mount which may be quickly readjusted to point the antenna towards a satellite in geosynchronous orbit.

Briefly, the antenna mount includes a base assembly rotatable around a first axis, an elevation adjustment assembly coupled to the base assembly and rotatable around a second axis, a vertical orientation adjustment assembly coupled to the elevation adjustment assembly and rotatable around a third axis, and a tracking adjustment assembly coupled to the vertical orientation adjustment assembly and rotatable around a fourth axis. The base assembly is attached to a tripod or support post, and the parabolic antenna is attached to the tracking adjustment assembly. The antenna is also coupled to the vertical orientation adjustment assembly by a sweep assembly which allows the antenna to be pointed at various locations along the satellite belt.

An advantage of this invention is that it can be rotated in three planes, making the antenna easy to set up, adjust, and readjust should the necessity arise due to the shifting of the mounting base.

Another advantage to this invention is that it can be quickly and easily adjusted by one person, as opposed to prior art mounts which often took a team of technicians to adjust.

In another advantage to this invention is that the antenna mount can be attached to a pole or tripod which is not vertical. This permits the antenna to be mounted on sloping surfaces, such as a roof, or even on a horizontal pole mounted on the side of a building.

Yet another advantage of this invention is that the antenna can be quickly and easily readjusted should the mounting pole or tripod shift due to frost heave or due to improper or insecure installation.

A still further advantage of this invention is that the sweep assembly, since it is attached to the vertical orientation adjustment assembly, rotates with the antenna. This eliminates the requirement for swivel or ball joints which were needed with prior art mounts because of the twisting action as the antenna sweeps across the satellite belt.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
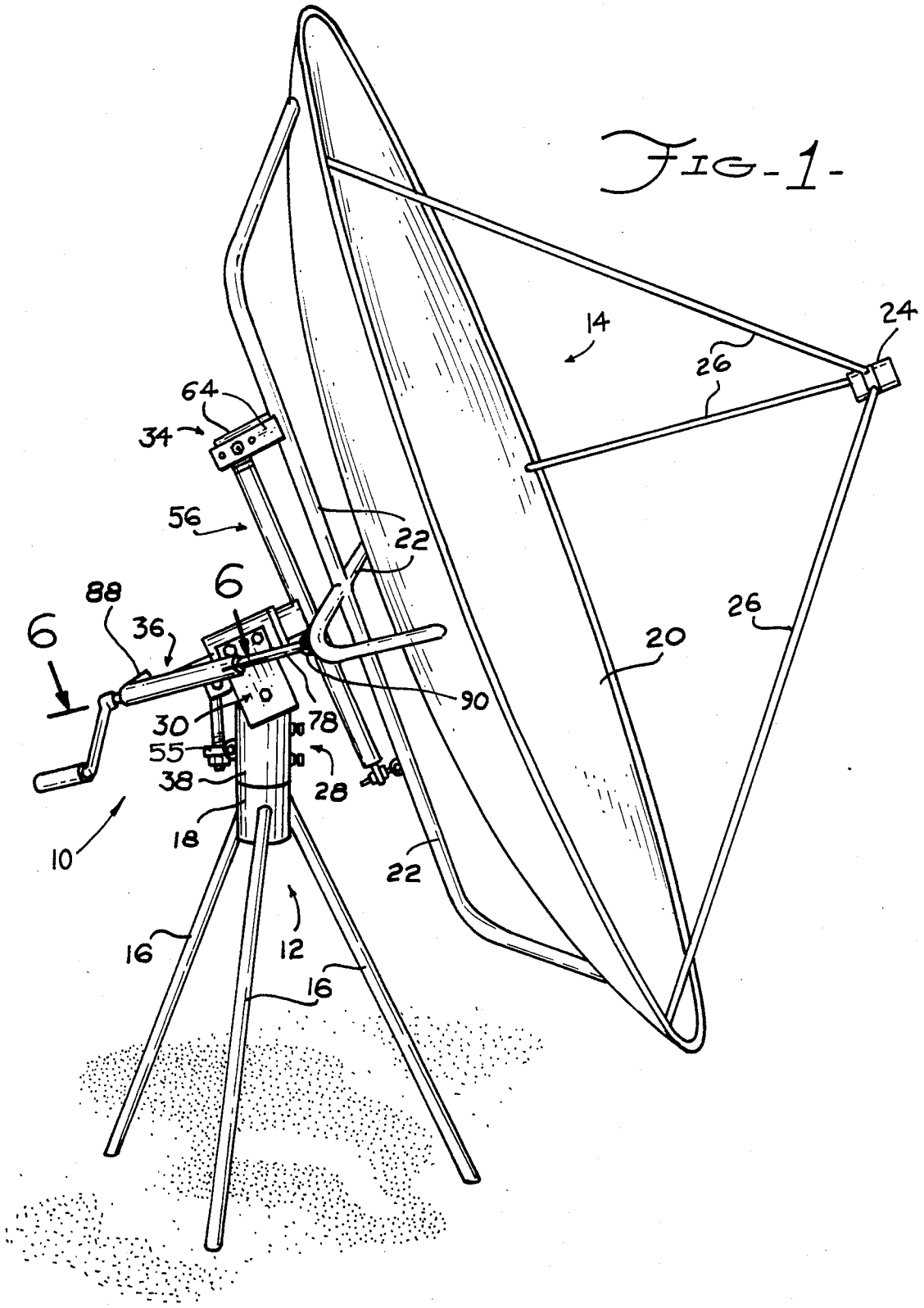
FIG. 1 is a perspective view of an antenna mount in accordance with the present invention, along with associated tripod base and parabolic antenna.

Referring to FIG. 1, an adjustable antenna mount 10 in accordance with the present invention is shown attached to a tripod 12 and a directional, parabolic antenna 14. The tripod 12 includes three legs 16 and a post 18 to which the legs are attached. Antenna 14 includes a parabolic dish 20, a mounting frame 22 attached to the underside of dish 20, a receiving element 24, and a number of struts 26 supporting the receiving element.

Figures 2, 3, 6, 7:
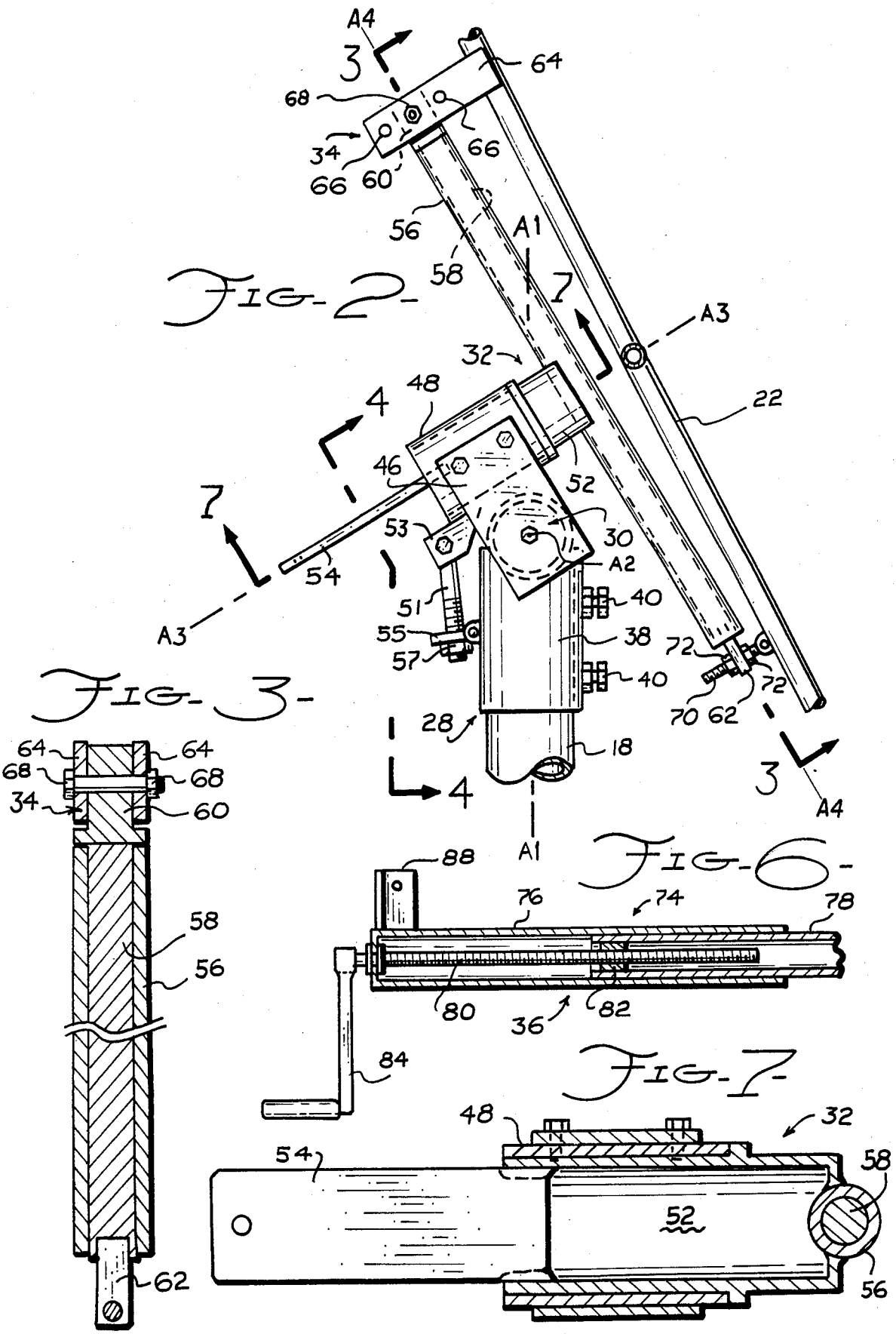
FIG. 2 is side elevation of a portion of an antenna mount.
FIG. 3 is a cross sectional view taken along line 3—3 of FIG. 2.
FIG. 6 is a cross sectional view taken along line 6—6 of FIG. 1.
FIG. 7 is a cross sectional view taken along line 7—7 of FIG. 2.

Referring now to FIGS. 1 and 2, the mount of the present invention includes a base assembly 28, an elevation adjustment assembly 30, a vertical orientation adjustment assembly 32, and a tracking adjustment assembly 34. A sweep assembly 36 is coupled between vertical orientation adjustment assembly 32 and frame 22 of antenna 14.

Figure 5:
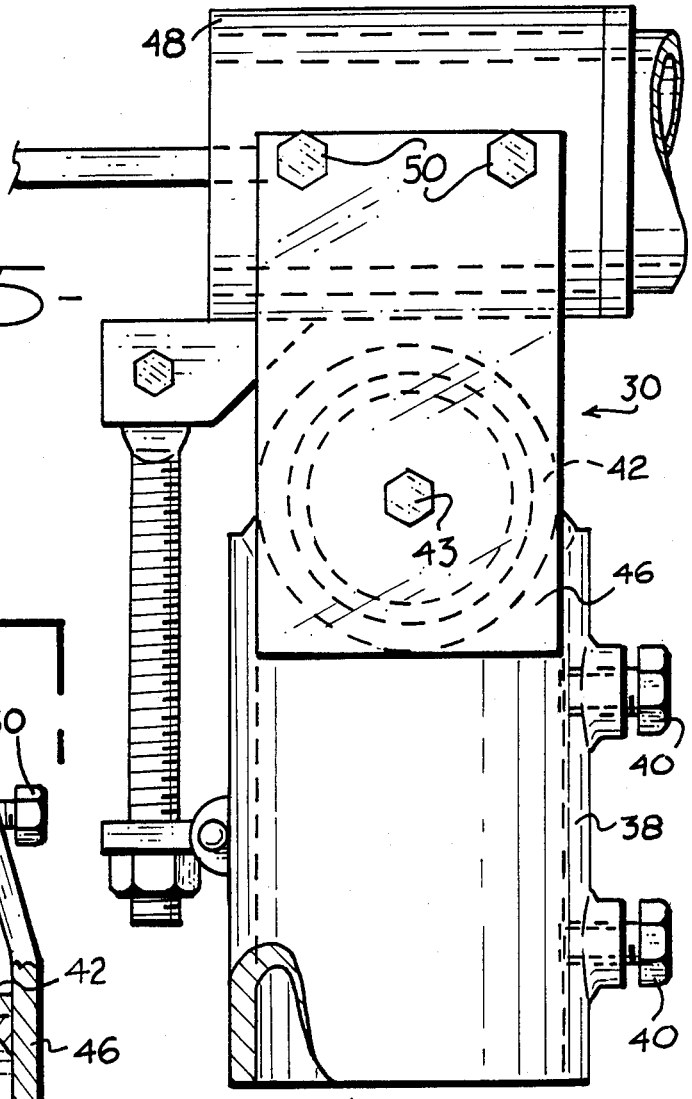
FIG. 5 is a view taken along 5—5 of FIG. 4.
Figure 4:
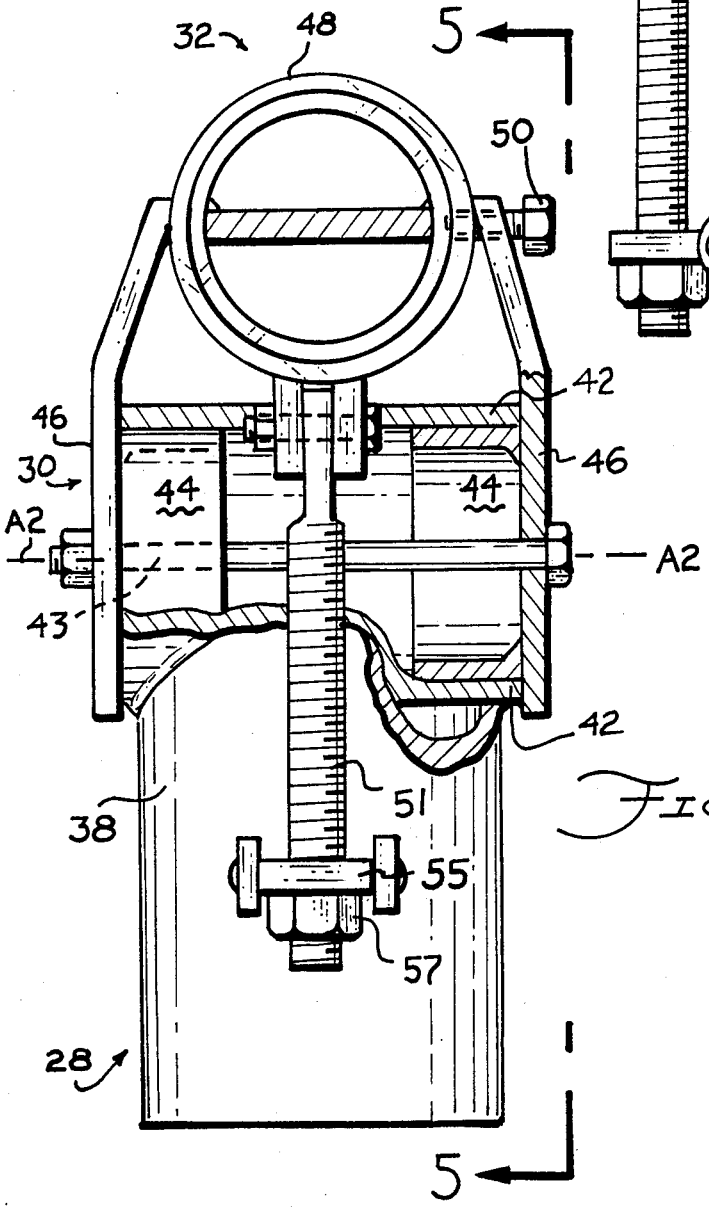
FIG. 4 is a view taken along 4—4 of FIG. 2.

Referring now to FIGS. 2, 4, and 5, base assembly 28 includes a base sleeve 38 which telescopes over the end of post 18. Alternately, sleeve 38 could telescope within post 18. Base sleeve 38 is provided with a pair of locking bolts 40 for selectively affixing base sleeve 38 to the post 18 within. Attached to and part of base assembly 28 is a cylindrical base bearing 42 which supports the elevation adjustment assembly 30.

Elevation adjustment assembly 30 includes a pair of base bearing engagement members 44 which are disposed within base bearing 42. A pair of frame members 46 are attached, preferably by welding, to the engagement members 44, and are, in turn, attached to a vertical orientation adjustment bearing 48. A pair of locking bolts 50 lock the vertical orientation assembly in position. The elevation adjustment assembly 30 is pivotally supported by bearing engagement member 44 and locked by a nut and bolt assembly 43.

An elevation adjustment bolt 51 extends between a clevis 53 and a flange 55. A nut 57 is en9aqed with an end of bolt 51 such that tightening nut 57 causes the elevation adjustment assembly to pivot around an axis A2 (see FIG. 4).

Referring now more particularly to FIG. 7, but also additionally to FIGS. 2 and 3, vertical orientation adjustment assembly 32 includes a bearing engagement member 52 which engages vertical orientation adjustment bearing 48, a sweep assembly support bar 54 attached to one end of bearing engagement member 52, and a tracking orientation bearing member 56 attached to the other end of bearing engagement member 52.

Tracking adjustment assembly 34 includes a bearing engagement member 58 which is disposed within tracking orientation bearing member 56. Attached to the upper end of tracking adjustment assembly 34 is the first flange member 60, and attached to the bottom of bearing engagement member 58 is a second flange member 62.

A pair of coarse adjustment straps 64 are attached at one end to frame 22 of antenna 14, and are provided with a number of spaced apart holes 66. A nut and bolt assembly 68 is inserted through a pair of holes in coarse adjustment strap 64 and engages a hole provided within first flange member 60.

An adjustment bolt 70 is attached at one end to frame 22, and engages a hole provided in second flange member 62. A pair of nuts 72 affixed a midlength portion of adjustment bolt 70 to the second flange member 62.

Referring now to FIGS. 1 and 6, sweep assembly 36 includes a screwjack 74 having an outer sleeve 76, an inner sleeve 78, an elongated drive screw 80 rotatably coupled to an end of outer sleeve 76, and a nut 82 coaxially attached with an inner sleeve 78 and engaging drive screw 80. A handle 84 is provided for rotating drive screw 80.

Outer sleeve 76 is coupled to the sweep assembly support bar 54 of vertical orientation adjustment assembly 32 by a connector 88. Inner sleeve 78 is coupled to frame 22 of antenna 14 by a clevis 90.

In operation, the tripod 12 is set up such that post 18 is as vertical as possible. Alternatively, post 18 can be set into the ground with concrete. Base sleeve 38 is engaged with post 18 and frame 22 of antenna 14 is attached to flanges 60 and 62 of the tracking adjustment assembly.

Antenna 14 is pointed in a due south direction by rotating the base assembly 28 around a first axis A1. When the antenna 14 is pointed due south, locking bolts 40 are used to firmly lock base sleeve 38 to post 18.

To obtain the proper elevation for antenna 14, nut 57 is loosened or tightened on elevation adjustment bolt 51 to cause the elevation adjustment assembly 30 to rotate around a second axis A2 (see FIG. 4) until the antenna is at approximately the correct elevation. Frame members 46 are then clamped to base bearing 42 by tightening nut and bolt assembly 43 to firmly lock it in position.

The vertical orientation of the antenna is adjusted by rotating the vertical orientation assembly around a third axis A3. Once the proper vertical orientation has been obtained, the vertical orientation assembly 32 is clamped to the elevation adjustment bearing 48 by locking bolts 50.

The offset of the antenna is coarsely adjusted by engaging nut and bolt assembly 68 with one of the three holes 66. The fine offset adjustment for the antenna is obtained by adjusting the attachment point of flange 62 to adjustment bolt 70. The offset of the antenna sweep axis A4 is determined by latitude and must be set accurately for a particular location.

The antenna 14 is swept along the satellite belt by rotating crank 84 of screwjack 74. Once the parabolic antenna 14 is focused the desired satellite, the adjustment of the antenna is complete.

It should be noted that the antenna mount 10 of the present invention does not require post 18 to be vertical, or even any where near vertical. If the orientation of post 18 shifts due, for example, to frost heave, the antenna mount can be readjusted as previously described to quickly aim the antenna 22 to the proper satellite.

While this invention has been described in terms of a few preferred embodiments, it is contemplated that persons reading the preceding descriptions and studying the drawing will realize various alterations, permutations and modifications thereof. For example, while the present invention is concerned with receiving information from apparently stationary satellites in geosynchronous orbit, with minor modifications it could be adapted to track satellites which are not in geosynchronous orbit. By providing suitably calibrated drive motors, the antenna could be caused to automatically move around its first, second, and third axes to continuously track a satellite as it moves from horizon to horizon.

It is therefore intended that the following appended claims be interpreted as including all such alterations, permutations and modifications as fall within the true spirit and scope of the present invention.

What is claimed is:

1. An adjustable antenna mount for attaching a directional antenna to a support, said antenna mount comprising:

a post defining a first axis and having opposed ends including a mounting end and a free end, a base assembly rotatable around the first axis and connected to the free end of the post, means for coupling said base assembly to said post, said means for coupling including a first sleeve-and-bearing arrangement with a sleeve rotatably fit about a bearing surface;

an elevation adjustment assembly rotatably coupled to said base assembly by a second sleeve-and-bearing arrangement and rotatable around a second axis substantially perpendicular to said first axis;

an antenna vertical orientation adjustment assembly rotatable coupled to said elevation adjustment assembly by a third sleeve-and-bearing arrangement and capable of rotation around a third-axis which is substantially perpendicular to said second axis;

a tracking adjustment assembly rotatably coupled to said vertical orientation adjustment assembly and antenna frame means for coupling said tracking adjustment assembly to said directional antenna, said tracking adjustment assembly coupled to the vertical orientation adjustment assembly by a fourth sleeve-and-bearing arrangement; and a sweep assembly coupled to said vertical orientation adjustment assembly, said sweep assembly having a means for rotating said tracking adjustment assembly around a fourth axis which is substantially perpendicular to said third axis, said tracking adjustment assembly having a means for adjusting the angle of said antenna frame means relative to said fourth axis.

2. An adjustable antenna mount as recited in claim 1 wherein said base assembly includes a first sleeve engagable with said post and a base locking means for selectively positioning said first sleeve to said post, said first sleeve having a lower and an upper end, said base assembly having a second sleeve attached to said upper end of said first sleeve for engagement with and support of said elevation adjustment assembly.

3. An adjustable antenna mount as recited in claim 2 wherein said elevation adjustment assembly includes a first bearing engagement member rotatably fit within said second sleeve of said base assembly, said elevation adjustment assembly further including an elevation adjustment frame attached to said first bearing engagement member said elevation adjustment frame having a lower extremity proximate said base assembly and an upper end, said elevation adjustment assembly having a third sleeve attached to the upper end of said elevation adjustment frame for engagement with said vertical orientation adjustment assembly, said antenna mount having a means for selectively fixing the angle of said third sleeve relative to said first sleeve.

4. An adjustable antenna mount as recited in claim 3 wherein said means for selectively fixing the angle of said third sleeve includes an elevation adjustment bolt coupled between said third sleeve and said base assembly, said first, second and third sleeve each comprising a hollow tubular sleeve having an inner bearing surface.

5. An adjustable antenna mount as recited in claim 4 wherein said vertical orientation adjustment assembly includes a second bearing engagement member engaging said inner bearing surface of said third sleeve, said vertical orientation adjustment assembly having a fourth sleeve and having a locking means for selectively positioning said second bearing engagement member within said third sleeve, said second bearing engagement member having a forward end fixed to said fourth sleeve.

6. An adjustable antenna mount as recited in claim 5 wherein said tracking adjustment assembly includes an elongated third bearing engagement member rotatably disposed within said fourth sleeve and includes means for changing the angle of said antenna frame means relative to said fourth axis attached to opposed ends of said elongated third bearing engagement member.

7. An adjustable antenna mount as recited in claim 6 wherein said means for adjusting the angle of said antenna frame means includes a coarse adjustment means provided at a first end of said third bearing engagement member, and a fine adjustment means provided at a second end of said third bearing engagement member.

8. An adjustable antenna mount as recited in claim 7 wherein said sweep assembly includes a screw crank assembly coupled between said vertical orientation adjustment assembly and said antenna frame means, whereby rotation of said vertical orientation adjustment assembly about said third axis rotates said tracking orientation assembly, said sweep assembly, said antenna frame means and said antenna.

9. An adjustable antenna mount for attaching a directional antenna to a support, said antenna mount comprising, a post defining a first axis and having opposed ends including a mounting end and a free end, a base assembly having an elongated first sleeve rotatably fit about a surface of said post to permit rotation of said base assembly about the first asis, said base assembly having a second sleeve fixed to one end of said first sleeve, an elevation adjustment assembly having a first bearing engagement member, said second sleeve of the base assembly rotatably fit about said first bearing engagement member of the elevation adjustment assembly for rotation of said elevation adjustment assembly about a second axis substantially perpendicular to said first axis, said elevation adjustment assembly having a third sleeve, a means for selectively adjusting the angle of said third sleeve relative to said first sleeve, a vertical orientation adjustment assembly having a second bearing engagement member rotatably fit within said third sleeve and capable of rotation about a third axis substantially perpendicular to said second axis, said vertical orientation adjustment assembly having a fourth sleeve, a tracking adjustment assembly having a third bearing engagement member rotatably fit within said fourth sleeve and capable of rotation about a fourth axis substantially perpendicular to said third axis, an antenna frame mounted to said tracking adjustment assembly, said tracking adjustment assembly having a means for adjusting the angle of said antenna frame relative to said fourth axis, and a sweep assembly coupling said vertical orientation adjustment assembly to said antenna frame, said sweep assembly having a means for rotating said tracking adjustment assembly about said fourth axis.

10. The antenna mount of claim 9 wherein said base assembly includes locking bolts penetrating said first sleeve for selectively locking said base assembly to said post.

11. The antenna mount of claim 9 wherein said means for selective adjusting the angle of said third sleeve relative to said first sleeve includes threaded bolt-and-nut arrangement coupling said first sleeve of the base assembly to said third sleeve of the elevation adjustment assembly.

12. The antenna mount of claim 9 wherein said third bearing engagement member of said tracking adjustment assembly has opposed first and second ends, said means for adjusting the angle of said antenna frame relative to said fourth axis including at least one flange coupling said first end of said third bearing engagement member to said antenna frame, said at least one flange having a plurality of holes for attachment to said third bearing engagement member.

13. The antenna mount of claim 12 wherein said means for adjusting the angle of said antenna frame relative to said fourth axis further includes an adjustable bolt-and-nut arrangement coupling said second end of said third bearing engagement member to said antenna frame.

14. The antenna mount of claim 9 wherein said vertical orientation assembly is capable of rotation of less than 360° about said third axis.

15. The antenna mount of claim 9 wherein said sweep assembly includes a screw crank coupling said vertical orientation adjustment assembly to said antenna frame.

16. The antenna mount of claim 11 wherein said third sleeve is disposed directly above said first sleeve.

* * * * *